US011125490B2

(12) United States Patent
Gatter et al.

(10) Patent No.: US 11,125,490 B2
(45) Date of Patent: Sep. 21, 2021

(54) FOOD-RECEIVING CONTAINER WITH A DIVIDING WALL HELD AT DIFFERENT HEIGHT LEVELS IN DIFFERENT SPATIAL DIRECTIONS AND METHOD FOR INSTALLING A DIVIDING WALL

(71) Applicant: BSH HAUSGERAETE GMBH, Munich (DE)

(72) Inventors: Andreas Gatter, Gerstetten (DE); Andrea Fink, Gerstetten (DE); Ralf Heyer, Gerstetten (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/898,661

(22) Filed: Jun. 11, 2020

(65) Prior Publication Data

US 2020/0393192 A1 Dec. 17, 2020

(30) Foreign Application Priority Data

Jun. 11, 2019 (DE) ..... 102019208449

(51) Int. Cl.

| | |
|---|---|
| ***A47B 88/90*** | (2017.01) |
| ***F25D 23/06*** | (2006.01) |
| ***A47B 88/975*** | (2017.01) |
| ***F25D 25/02*** | (2006.01) |

(52) U.S. Cl.

CPC ..... *F25D 23/069* (2013.01); *A47B 88/975* (2017.01); *F25D 25/025* (2013.01); *F25D 2325/021* (2013.01)

(58) Field of Classification Search

CPC ... F25D 23/069; F25D 25/025; A47B 88/975; A47B 88/90

See application file for complete search history.

(56) References Cited

U.S. PATENT DOCUMENTS

| | | | | |
|---|---|---|---|---|
| 7,588,162 | B2 * | 9/2009 | Dube | A47B 88/90 220/552 |
| 7,681,746 | B2 * | 3/2010 | Schmidt | A47F 5/005 211/184 |
| 9,700,156 | B1 * | 7/2017 | Hance | A47F 5/005 |

(Continued)

FOREIGN PATENT DOCUMENTS

| | | | | |
|---|---|---|---|---|
| DE | 102008019360 | A1 | 10/2009 | |
| EP | 0371937 | A2 * | 6/1990 | A47B 88/975 |

*Primary Examiner* — Kimberley S Wright

(74) *Attorney, Agent, or Firm* — Laurence A. Greenberg; Werner H. Stemer; Ralph E. Locher

(57) ABSTRACT

A food-receiving container for a household refrigeration appliance includes a receiving bin and a separate dividing wall for insertion from above into the bin to divide the bin. A positioning device, which positions the wall during installation and in a final position, includes a first positioning unit of the bin and a second positioning unit of the wall. The positioning units engage for positioning the wall to the bin. The positioning units automatically establish different holding states of the wall and bin at different insertion height positions, depending on the insertion height position of the wall into the bin. The insertion height positions differ in a number of holding states and a number of spatial directions in which they act. The position of the wall in the bin is fixed in three spatial directions in the final pushed-in position. A method for installing a wall is also provided.

16 Claims, 9 Drawing Sheets

(56) References Cited

U.S. PATENT DOCUMENTS

| | | | | |
|---|---|---|---|---|
| 10,772,424 | B2 * | 9/2020 | Turner | A47B 57/58 |
| 10,869,562 | B1 * | 12/2020 | Bryan | A47B 57/58 |
| 2006/0108368 | A1 * | 5/2006 | Dube | A47B 88/981 220/552 |
| 2008/0128428 | A1 * | 6/2008 | Beckerman | B65D 25/06 220/532 |
| 2010/0219147 | A1 * | 9/2010 | Moody | F25D 25/022 211/181.1 |
| 2019/0031391 | A1 * | 1/2019 | Montanari-Ibarra | B65D 21/0213 |
| 2019/0078835 | A1 * | 3/2019 | Gatter | F25D 25/005 |
| 2019/0281982 | A1 * | 9/2019 | Turner | A47B 57/58 |

* cited by examiner

FOOD-RECEIVING CONTAINER WITH A DIVIDING WALL HELD AT DIFFERENT HEIGHT LEVELS IN DIFFERENT SPATIAL DIRECTIONS AND METHOD FOR INSTALLING A DIVIDING WALL

CROSS-REFERENCE TO RELATED APPLICATION

This application claims the priority, under 35 U.S.C. § 119, of German Patent Application DE 10 2019 208 449, filed Jun. 11, 2019; the prior application is herewith incorporated by reference in its entirety.

BACKGROUND OF THE INVENTION

Field of the Invention

One aspect of the invention relates to a food-receiving container for a household refrigeration appliance. The food-receiving container includes a receiving bin. In addition, the food-receiving container includes a dividing wall separate therefrom. The dividing wall can be inserted vertically oriented from above into the receiving bin in order to divide the volume of the interior space of the receiving bin. The food-receiving container includes a positioning device with which the dividing wall is specifically positioned when installed in the receiving bin and in the final installed position. The positioning device includes a first positioning unit formed in one piece with the receiving bin. The positioning device includes a second positioning unit separate therefrom and formed in one piece with the dividing wall. The positioning units engage with one another for the specific positioning of the dividing wall in relation to or in the receiving bin. A further aspect of the invention relates to a method for installing a dividing wall in a receiving bin of a food-receiving container for a household refrigeration appliance.

Food-receiving containers including a receiving bin and a dividing wall separate therefrom that can be inserted into the receiving bin in order to divide the volume of the interior of the receiving bin are known. For example, a corresponding chilled goods container is known from German Patent Application DE 10 2008 019 360 A1. The chilled goods container includes a box and a partition that can be inserted into the box. The partition embodied as a grid includes anchoring elements on opposite vertical edges. Those anchoring elements are embodied as strips with a round cross section. For that purpose, multipart embodiments are formed with material webs that surround a solid pin. The anchoring elements are plugged into complementary shaped recesses embodied on the inner side of side walls of the box. In particular, precise fitting is provided in that case. The anchoring elements and the recesses are embodied identically over their entire vertical height. In addition, hook-shaped second anchoring elements are embodied on an upper end of the partition and are entirely disposed at the same height level. In the final position of the partition, they are immersed into open-top cutouts on the box embodied on the edge of side walls of the box. In the known embodiment from the prior art, the partition is fixed simultaneously in two spatial directions oriented in the horizontal direction and perpendicular to the vertical push-in direction on two opposite sides of the partition when insertion into the box begins. That, on one hand, complicates the threading of the partition into the box. Moreover, on the other hand, the final installed position is also only fixed in those two spatial directions. That can result in unwanted changes of position.

SUMMARY OF THE INVENTION

It is accordingly an object of the invention to provide a food-receiving container with a dividing wall held at different height levels in different spatial directions and a method for installing a dividing wall, which overcome the hereinafore-mentioned disadvantages of the heretofore-known containers and methods of this general type and with which the installation of a dividing wall is improved with regard to how it is held on a receiving bin.

With the foregoing and other objects in view there is provided, in accordance with the invention, a food-receiving container for a household refrigeration appliance. The food-receiving container includes a receiving bin. In addition, the food-receiving container includes an, in particular plate-like, dividing wall separate therefrom. This dividing wall can be inserted into the receiving bin in a non-destructively releasable manner in order to divide the volume of the interior space of the receiving bin. In order to divide the volume of the interior space, the receiving bin can be inserted from above into the receiving bin, in particular vertically oriented. The food-receiving container includes a positioning device with which the dividing wall is specifically positioned when being installed in the receiving bin and in the final installed position. The positioning device includes a first positioning unit embodied in one piece with the receiving bin. In addition, the positioning device includes a second positioning unit separate from the first positioning unit embodied in one piece with the dividing wall. The two positioning units engage with one another for the specific positioning of the dividing wall in relation to the receiving bin. Depending on the insertion position of the dividing wall into the receiving bin, viewed in the height direction, different, in each case associated defined coupled holding states of the dividing wall with the receiving bin are automatically established at a plurality of different and hence in particular discrete insertion height positions by the mechanically coupling and mutually engaging positioning units. These different coupled holding states in the different insertion height positions differ in the number of spatial directions in which the coupled holding state acts. In the final pushed-in position of the dividing wall into the receiving bin, the position of the dividing wall is fixed in the receiving bin in all three spatial directions. Such an embodiment of a food-receiving container achieves an improved concept in order, on one hand, to improve the installation of the dividing wall and, on the other, to be able to hold it specifically.

The installation concept is improved due to the fact that the number of the then achievable coupled holding states of the dividing wall in the receiving bin increases as the pushed-in depth of the dividing wall into the receiving bin increases. This provides simple handling for the user even at the very beginning of the insertion. On the other hand, as the insertion depth increases, the dividing wall is held increasingly well and in an improved manner in order then, in particular at the latest in the complete final pushed-in position, to be fixed in all three spatial directions. The fact that this increase in the coupled holding states does not take place continuously, but the increase in each case takes place discretely at discrete insertion height positions enables a further improvement of the installation. Hence, at specific discrete height levels, it is also easily identifiable and convenient for a user that positioning units subsequently couple or are coupled such that a further coupled holding state is created in a further spatial direction. Such a concept simplifies the basic threading of the dividing wall into the receiving bin. Hence, it is relatively easy to find and establish an initial position in which the dividing wall basically comes into contact with the receiving bin. In particular in this state and hence the initial position of the installation, a very simple mechanical coupling state is achieved between the two positioning units. On this basis of this, it is then also possible to create a very simple scenario for guiding the dividing wall downward into the receiving bin. In particular, in this context, there is no need for a complicated positioning and threading process of the dividing wall in relation to the receiving bin to be performed at the very beginning and hence at the initial position.

Hence, this embodiment of the food-receiving container has the result that different coupled holding states are established on the route from the initial position to the final position of the dividing wall in the receiving bin. In particular, at least one insertion height position different from the initial position and the final position is embodied in which a coupled holding state is established including a holding in only two spatial directions. The number of spatial directions in which the dividing wall is held is greater than it is at the insertion height position corresponding to the initial position of installation and lower than it is at the insertion height position corresponding to the final position.

A coupled holding state can be a guiding state and/or a holding state. A coupled holding state in one spatial direction is in particular and generally defined by the fact that the positioning units are disposed coupled with one another and mutually engaging with one another such that, in this spatial direction, the dividing wall can be moved back and forth relative to the receiving bin without play or with maximum play of less than or equal to 5 mm, in particular less than or equal to 3 mm. This applies in particular to all discrete coupled holding states enabled by the mutually engaged coupling of the positioning units and to all associated spatial directions. In particular, for the insertion height position in which coupled holding states are embodied, the guidance and/or holding is achieved in two spatial directions. In particular, this applies to the insertion height position in which coupled holding states are embodied in which the guidance and/or holding is achieved in all three spatial directions. At least one coupled holding state is embodied as captive. This is in particular the case in insertion height levels in which a coupled holding state is embodied by the coupled positioning units in at least in two spatial directions.

In particular, it is provided that the positioning device is embodied such that, at the initial position of the dividing wall, a coupled holding state is only provided in one single spatial direction. This is in particular the width direction. In one advantageous embodiment, it can be provided that coupled holding states are only created in all three spatial directions in the fully final pushed-in position of the dividing wall in the receiving bin. In particular, the coupled holding state of the dividing wall is achieved in two spatial directions at a specific or discrete insertion height position of the dividing wall into the receiving bin, wherein this discrete insertion height position is not the initial position and not the final position.

In particular, the number of different coupled holding states is lower at a higher-level insertion height position than it is at a lower-level insertion height position viewed in the height direction. In particular, the number of different coupled holding states increases steadily as the vertical insertion length of the dividing wall into the receiving bin increases.

In one advantageous embodiment, it is provided that, at an upper first insertion height position of the dividing wall into the receiving bin in the height direction, the positioning units are directly coupled and as a result a first coupled holding state is established in which the dividing wall is embodied in only one spatial direction that is directed perpendicular to the areal extension of the dividing wall. This is in particular the width direction of the food-receiving container. It can be provided that this is a holding with play in this first spatial direction. However, it is also possible for a holding without play to be provided in this specific first spatial direction.

It is preferably provided that in a lower-lying further, second insertion height position of the dividing wall into the receiving bin, the positioning units are directly coupled and, as a result, in addition to the first coupled holding state a second coupled holding state is established. In this second coupled holding state, the dividing wall is embodied in a further spatial direction directed in the direction of the areal extension of the dividing wall. It can hence be provided that, when it has achieved this second insertion height position, the dividing wall is held in the two spatial directions that are oriented perpendicular to the vertical insertion direction.

In one advantageous embodiment, it is provided that, in the final fully inserted or pushed-in position, which is a still lower-lying third insertion height position, of the dividing wall into the receiving bin, the positioning units are directly coupled and engaged with one another and as a result, in addition to the first and second coupled holding state, a third coupled holding state is established in which the dividing wall is held in a defined manner in a further spatial direction corresponding to the insertion direction of the dividing wall into the receiving bin.

In one advantageous embodiment, it is provided that the coupled holding state in the third spatial direction, which is in particular established in the final fully inserted position and preferably also only achieved there, the dividing wall is not able to leave this position autonomously. This in particular also means that, in this fully pushed-in position and due to this third coupled holding state, the dividing wall still remains in the final position achieved if the food-receiving container were to be tilted, in particular even tilted by 180°. In particular, the dividing wall is hence also locked in this third coupled holding state. Such locking in particular is a fully self-holding position. In particular, this dividing wall can only be released from the final fully pushed-in final position by releasing the third coupled holding state. This can be done by the user himself or herself, for example by actuating the locking with a finger or by using a tool. Hence this third coupled holding state is also securely held. In this final position, all three holding states act individually and hence in all three spatial directions.

In one advantageous embodiment, it is provided that a positioning unit includes at least one vertically oriented groove in which positioning ribs are embodied at different height levels. These positioning ribs, which are embodied at discrete height levels, are disposed such that, when in the coupled state with the other positioning unit, the groove establishes a coupled holding state of the dividing wall in one spatial direction and the positioning ribs establish a coupled holding state of the dividing wall in a further spatial direction perpendicular thereto. This results in an interaction between two specific geometric embodiments such that coupled holding states are automatically enabled in quite specific, in particular horizontal, spatial directions.

A positioning rib is embodied or disposed on the groove such that an inside width of the groove is locally restricted in at least one horizontal spatial direction so that, upon the insertion of the dividing wall and the subsequent coupling between the first positioning unit and the positioning rib, the coupled holding state is established in this horizontal spatial direction. In particular, such a coupled holding state is formed in the spatial direction in which the dividing wall extends two-dimensionally. The fact that this positioning rib is embodied on this groove itself both achieves a compact structure and provides a mechanically highly functional principle of action. Hence, the first positioning unit is then guided through the groove to arrive reliably at this positioning rib. In addition, this embodiment with the positioning rib in the groove also ensures that on its vertical route downward during the insertion process, this first positioning unit also passes this positioning rib and hence this holding in the second spatial direction is automatically achieved. This is in particular also a captive coupled holding state. The groove is then preferably restricted by the base of the groove and the opposite plate-like positioning rib. In this case, the positioning rib represents a top of the groove. In particular, the possible play of the bar, in particular a top of the T of an in particular T-shaped bar, is formed between the base of the groove and the positioning rib. However, it is also possible for a precisely fitting and play-free configuration to be provided in this second spatial direction. In particular, a positioning rib can be disposed on a groove such that play is formed for the bar in the second spatial direction that is to be held. A further positioning rib, in particular an upper positioning rib, can be disposed such that a play-free configuration of the bar is embodied in the groove. In particular, this positioning rib can be embodied like a ramp or in a wedge shape so that the groove tapers continuously.

The groove is open in the depth direction of the food-receiving container, in particular open toward the rear. The positioning rib closes the groove on the open side. It closes the groove on a side opposite to the base of the groove. In this second spatial direction, a captive coupled holding state is also achieved between the mutually engaging positioning units at this insertion height position.

Hence, the specific orientation of the positioning rib in the groove causes the dividing wall to be automatically pushed or pulled into the correct position in this second spatial direction when the positioning rib is thus reached.

In one advantageous embodiment, it is provided that at least two, in particular at least three, positioning ribs are embodied spaced apart from one another in the groove in different height levels and hence at discrete height levels. This is a further very advantageous concept since, on one hand, these discrete heights improve the coupled holding state in the second spatial direction and it is hence held at many discrete points. On the other hand, this also makes it possible that, during the process of the insertion of the dividing wall into the receiving bin, even if only one of these positioning ribs disposed at different height levels is passed, although in two spatial directions a coupled holding state is provided in these two spatial directions at a specific place on the dividing wall, this is not yet provided in other sections of the dividing wall, in particular in sections of the dividing wall lying higher up. This enables the dividing wall to retain a position to enable it to tilt around this spatial direction at least in the upper region.

It is preferably provided that the other positioning unit includes at least one bar, in particular with a T-shaped cross section. This T-shaped bar is preferably vertically oriented. In the coupled state, this T-shaped bar engages with the positioning unit in the groove. This T-shape is embodied in a plane which is the horizontal plane. This horizontal plane is formed perpendicular to the insertion direction or pushed in direction of the dividing wall into the receiving bin. Such an embodiment of a first positioning unit can, on one hand, form a mechanically stable and deformation-resistant element. On the other hand, due to the T-shape, it is only embodied in a certain width in a front region, namely the top of the T. On the other hand, the stem of the T is embodied with a lower thickness and is hence more delicate. This shape also enables a material-saving element of the first positioning unit. In addition, this shape created by the top of the T forms a central element which is advantageous for the coupling with the second positioning unit. On one hand, this improves the engaging into the positioning unit that is preferably embodied as a groove and on the other it improves the creation of the possibility of coupling with the positioning rib in order bring it into the correct position continuously and without jamming and without distortion in this second spatial direction as well.

This bar is advantageously embodied without interruption over its entire length. This prevents a decoupled and a lateral (in the first spatial direction and hence perpendicular to the longitudinal axis of the groove) slippage out of the groove when a coupling is embodied between the bar and the groove. In addition, as a result of this, it is advantageously enabled that, due to a slot in the plate-shaped positioning rib, the slot being in particular vertical and fully continuous in height, the stem of the T engages through into the groove and the top of the T engages behind the positioning rib. The positioning rib in particular forms a top of the groove and lies opposite the base of the groove.

In one advantageous embodiment, it is provided that the other positioning unit includes a first T-shaped bar of which the upper end in the height direction is located at a first height level. The positioning unit preferably includes a second vertically oriented T-shaped bar separate therefrom of which the upper end in the height direction is located at a second height level that is lower than the first height level. This is a very advantageous embodiment because these two separate T-shaped bars, the upper ends of which terminate at different height levels, can create very individual coupling scenarios. In this context, it is particularly advantageously enabled that already in the initial position in which the dividing wall first comes into contact with the receiving bin, only one of these two T-shaped bars couples with only one of at least two elements of the positioning unit that are preferably embodied as grooves. As a result, it is already particularly advantageously enabled in this initial position in particular that a coupled holding state is embodied only in one spatial direction. In particular, this spatial direction is a horizontal spatial direction, in particular the width direction of the food-receiving container.

This embodiment with upper ends of the T-shaped bars at different height levels enables it to be achieved that initially only one element of the positioning unit is coupled with this higher-level T-shaped bar and in this state the other T-shaped bar is then not yet coupled with the further element of the positioning unit.

In one advantageous embodiment, it is provided that the positioning unit includes a first groove and a second groove separate therefrom that extends vertically. In the first upper insertion height position, only the first, in particular T-shaped, bar is coupled with its first groove and engages into this first groove. In this upper insertion height position, the second groove of the positioning unit is decoupled from the second, in particular T-shaped, bar of the other positioning unit. This enables the aforementioned advantages.

In a further insertion height position lying lower than the upper insertion height position in the height direction, an installation state is then achieved in which this second, in particular T-shaped, bar is additionally coupled with the second groove and engages in the second groove. This discrete second insertion height position then creates the automatic coupled holding state in the second spatial direction. On the other hand, in this upper insertion height level or insertion height position, the coupled holding state is created such that it is only defined in one spatial direction. In particular, this spatial direction is the width direction.

It is preferably provided that the positioning unit is the second positioning unit and the other positioning unit is the first positioning unit. In one exemplary embodiment, this means that the two grooves are embodied on the dividing wall. In particular, this means that the bars, which are in particular embodied as T-shaped, are embodied on the walls of the receiving bin. However, it can also be provided that the grooves are embodied on the walls, in particular the inner sides of the walls, of the receiving bin and the bars, which are in particular T-shaped, are embodied on the dividing wall.

In one advantageous embodiment, it is provided that the first groove is embodied on a first vertical edge of the dividing wall. The first groove extends in a straight line and in the height direction. In particular, this first groove extends over the entire height of this first edge. In one embodiment, it can be provided that the second groove is embodied on an opposite vertical edge of the dividing wall. In this case again, in particular a one-piece embodiment with the dividing wall is provided. It can be provided that this second groove is in a straight line and fully vertically oriented. This second groove can extend over the entire height of this second vertical edge of the dividing wall. The second groove can also be embodied completely without interruption. In particular, the two grooves are parallel to one another.

It can be provided that the first bar is embodied over at least 70%, in particular at least 80%, in particular at least 90%, in particular the entire height of an inner side on a wall of the receiving bin. In particular, this can be the rear wall of the receiving bin. The bar is preferably embodied without interruption over its entire length. It is embodied in a straight line and fully vertically oriented. It can be provided that the second bar is embodied on an inner side of a further, in particular opposite, wall of the receiving bin. This wall can be a front wall of the receiving bin. In particular, this second bar extends over at least 70%, in particular at least 80%, in particular at least 90%, in particular the entire height of this further wall. The second bar is in particular embodied without interruption. In particular, the second bar is parallel to the first bar.

In one advantageous embodiment, it is provided that in each of the two grooves, in each case a plurality of positioning ribs, in particular in each case three positioning ribs, are embodied in one piece and extend in the respective groove.

In one advantageous embodiment, it is provided that, viewed in the height direction, the second groove is longer than the first groove. In particular, upper ends of the grooves are embodied at different height levels. This simplifies the insertion of the dividing wall at the start of the installation.

In one advantageous embodiment, it is provided that an upper positioning rib is embodied at the upper end of a groove. This advantageously applies to both grooves if they are embodied and the upper ends of these two grooves are embodied at different height levels. In one advantageous embodiment, it is provided that second positioning ribs, which are embodied as lower-lying than upper third positioning ribs in the height direction, are embodied in a groove in a middle third of the length measured in the height direction. In particular, these second positioning ribs are embodied approximately in the middle when viewed over the respective height of a groove.

It is preferably provided that first positioning ribs are embodied in a lower third of the length of a respective groove. In particular, the first positioning ribs are disposed spaced apart from the lower end of the grooves.

In one advantageous embodiment, it is provided that these lower first positioning ribs with the two grooves are embodied at the same height level. The subsequent second and/or third positioning ribs in the upward direction are then, when viewed in comparison with each other, embodied in the individual grooves at different height levels. In particular, the second positioning rib in the higher groove in the upward direction is disposed at a higher height level than the second positioning rib in the shorter or lower groove. In particular, the uppermost third positioning rib is disposed further up in the higher groove in the upward direction and hence at a higher height level than the third uppermost positioning rib of the shorter groove in the upward direction.

In one advantageous embodiment, it is provided that the first positioning unit is embodied on an inner side of at least one side wall, in particular on at least one side wall and one base wall, of the receiving bin. In particular, for this purpose, the first positioning unit is preferably also embodied on an inner side of a first side wall and an inner side of an opposite second side wall of the receiving bin. In particular, the positioning unit is embodied on the inner sides of these two side walls and on the base wall. Additionally or alternatively, it is provided that the second positioning unit is embodied on at least one vertical edge of the dividing wall, in particular on a first vertical edge of the dividing wall and an opposite second vertical edge of the dividing wall. In the depth direction of the food-receiving container, the first vertical edge can be a rear vertical edge of the dividing wall and the second vertical edge a front vertical edge of the dividing wall. The first side wall of the receiving bin can be a rear wall. The second side wall of the receiving bin can be a front wall.

In one advantageous embodiment, it is provided that the first positioning unit includes at least one latching element, which is coupled with at least one counter-latching element of the second positioning unit. This coupled state of this latching element and the counter-latching element establishes a fixing of the position of the dividing wall in the spatial direction corresponding to the insertion direction as a coupled holding state. Hence, in particular in the final fully inserted position of the dividing wall into the receiving bin, this fixing of the position is achieved in this third spatial direction, in particular at least additionally created by this latching between the latching element and the counter-latching element. This is a further very advantageous embodiment since the dividing wall as a whole is hence also held precisely in this final inserted position even if the receiving bin is tilted or even fully rotated. The dividing wall is then prevented from falling out or slipping out. Precisely the embodiment of the positioning units with the latching element and the counter-latching element enables this position fixing also to be locked in the third spatial direction. In particular, such locking is only provided in this third spatial direction. In particular, the locking is only embodied in the final fully pushed-in final position of the dividing wall into the receiving bin.

In particular, this locking by latching the latching element with the counter-latching element is self-locking. It is achieved automatically when the dividing wall is brought into the fully pushed-in final position. In particular, this locked third coupled holding state cannot be released autonomously. It can only be released by a user, in particular only with a tool.

It is preferably provided that the first positioning unit includes a first resilient latching element, which is embodied in a resilient manner about a first axis. This first axis is oriented in a horizontal first spatial direction. In addition, the first positioning unit advantageously includes a second resilient latching element separate therefrom. This second resilient latching element is embodied in a resilient manner about a second axis, which is oriented in a second horizontal spatial direction oriented perpendicular to the first spatial direction. This is a further very advantageous embodiment because these two latching elements are hence oriented in different directions so that their resilient action and hence their latching direction act in two different spatial directions, which are in particular oriented perpendicular to one another. As a result, the locked state of the third coupled holding state is achieved particularly advantageously. This further improves the prevention of an unwanted autonomous decoupling of this locked state.

The first axis is preferably oriented in the depth direction of the food-receiving container. The second axis is preferably oriented in the width direction of the food-receiving container.

In one advantageous embodiment, it is provided that the latching elements are embodied in one piece on a base wall of the receiving bin. Viewed in the height direction of the food-receiving container, the two latching elements are embodied as upward-protruding. Viewed in the depth direction of the food-receiving container, the first resilient latching element is preferably embodied in a rear region of the base wall. In particular, viewed in the depth direction of the food-receiving container, the second latching element is embodied in a front region, in particular on a front end region of the base wall. This position of the two latching elements, which are hence in particular spaced apart to a maximum degree in the depth direction, enables the locking position fixing of the dividing wall to be further improved. Hence, viewed in this depth direction, the respective latching point or the locking point is embodied at the end positions.

It is preferably provided that the dividing wall includes at least one screw boss into which a separate screw can be screwed. This enables the dividing wall to be additionally screwed to the positioning device and the receiving bin.

In particular, the positioning device is embodied without separate fastening devices. Therefore, the screwing of the dividing wall could be considered to be a fastening device separate from the positioning device.

In particular, the screw boss is oriented with its opening facing downward. Hence, the separate screw can be screwed in from below against the insertion direction of the dividing wall into the receiving bin. In particular, the dividing wall can hence be screwed from the underside of the receiving bin, in particular through the base wall, to the receiving bin.

With the objects of the invention in view, there is concomitantly provided a method for installing a dividing wall of a food-receiving container in a receiving bin of the food-receiving container. Viewed in the height direction of the food-receiving container, the dividing wall is inserted from above into the receiving bin. In the receiving bin, the dividing wall is fixed to the receiving bin itself. The food-receiving container includes a positioning device with which, when installed in the receiving bin and in the final installed position, the dividing wall is specifically positioned, in particular guided and positioned. The positioning device includes a first positioning unit embodied in one piece with the receiving bin. The positioning device includes a second positioning unit separate therefrom embodied in one piece with the dividing wall. The positioning units are coupled with each other directly for the specific positioning of the dividing wall in relation to the receiving bin or in the receiving bin. In this case, the positioning units are fitted in engagement with each other. The positioning units are coupled directly with one another. Depending on the insertion position of the dividing wall into the receiving bin viewed in the height direction, different, in each case associated defined coupled holding states of the dividing wall with the receiving bin are automatically established at different defined and in particular discrete insertion height positions by the mechanically coupling and mutually engaging positioning units. These discrete insertion height positions are different from the final pushed-in position of the dividing wall into the receiving bin. The different coupled holding states differ in the direction in which they act. The different discrete insertion height positions differ in the number of coupled holding states which act and hence the number of spatial directions in which the coupled and mutually engaging positioning units act in each case. In the final pushed-in position of the dividing wall into the receiving bin, the position of the dividing wall is fixed in all three spatial directions. This installation method achieves the advantages explained with regard to the food-receiving container.

Advantageous embodiments of the food-receiving container should be considered to be advantageous embodiments of the method. In particular, the material features with regard to the food-receiving container are provided to perform and achieve the respective method steps for the installation of the dividing wall.

For example, in this context it is advantageously provided that, upon the commencement of the installation, the dividing wall initially only embodies a coupled holding state defined in one single spatial direction. In particular, this has the result that a positioning unit is embodied with elements of different heights in the height direction, in particular bars, with upper ends located at different height levels. Hence, upon insertion, the elements of the other positioning unit, which are embodied on the dividing wall, are not simultaneously in contact with these elements of the positioning unit on the receiving bin side. Instead, herein, a state is achieved such that, in the initial position of the dividing wall, at which there is already direct contact between the positioning units, only one element of a positioning unit is directly coupled with only one element of the other positioning unit. In this initial position of the dividing wall, the two other elements of the positioning units are not yet directly coupled to one another. In particular, in this context, a first groove, which is a component of one of the two positioning units, is directly coupled with an, in particular T-shaped, bar, which is a component and an element of the other positioning unit. A further groove of the positioning unit and a further, in particular T-shaped, bar of the other positioning unit are then not yet in contact. As a result, in this initial position, a coupled holding state of the dividing wall is established in only one spatial direction, in particular in the width direction of the food-receiving container. If the dividing wall is then subsequently pushed vertically further down into the receiving bin, there is also direct contact between a further groove and the further, in particular T-shaped, bar at a lower-lying insertion height position. In particular, in this insertion height position, the dividing wall is then is in direct contact with opposite side walls at opposite edges.

In one advantageous embodiment, it is provided that, before this setting and hence in a still higher-level state of the dividing wall in the coupled state between this first bar and the first groove (in this case, the second groove and the second bar are not yet coupled), a coupled holding state is established in a second spatial direction. This takes place in that the one bar coupled with a groove achieves a position in the groove in which it is in contact with a positioning rib embodied in the groove. This positioning rib tapers the groove in a second spatial direction, in particular the depth direction of the food-receiving container or closes the groove at its opening. If, during the insertion of the dividing wall into the receiving bin, the bar reaches this positioning rib, it is also brought to a level or position by which, in the second spatial direction, which is in particular the depth direction of the food-receiving container, the dividing wall is disposed captively in this second spatial direction. As explained above, this advantageously results in an installation state in which the other groove and the other bar of the two positioning units are not yet coupled. This direct coupling between the further bar and the further groove also only takes place when the dividing wall is subsequently pushed further downward.

If the dividing wall is then pushed further downward into the receiving bin, the further bar also contacts or overlaps in the height direction a first positioning rib, which is embodied in this further groove, thus also again causing the coupled holding state to be advantageously supported in the second spatial direction.

If the dividing wall is guided further downward into the receiving bin, subsequently additional defined discrete insertion height positions are achieved at which the bars in each case in turn reach second positioning ribs, in particular simultaneously, in the respective grooves. As a result, the coupled holding states of the dividing wall are achieved simultaneously in two spatial directions even in higher-level sections of the dividing wall and not only enabled at the initially only lower region of the dividing wall. Upon the further insertion of the dividing wall into the receiving bin, the fully pushed-in final state or final position is then achieved. In this position, in particular an automatically locked state is created. In particular, at least one latching element latches with at least one counter-latching element, which are in each case components of the positioning units so that, in the final pushed-in position, the dividing wall is fixed in position in the third spatial direction. This third coupled holding state is in addition also locked by the latching of the elements.

It can be provided that, in addition to the positioning device embodied without separate fastening devices, the dividing wall is screwed with at least one separate fastening element, such as for example a screw.

The terms "above," "below," "front," "rear," "horizontal," "vertical," "depth direction," "width direction," "height direction," etc. define the positions and orientations for the intended use and intended configuration of the food-receiving container.

Further features of the invention may be derived from the claims, the figures and the description of the figures. The features and combinations of features cited above in the description and the features and combinations of features cited hereinafter in the description of the figures and/or shown solely in the figures are not only able to be used in the combination specified in each case but also in other combinations without departing from the scope of the invention. Hence, embodiments of the invention that are not explicitly shown and explained in the figures but may be derived and produced by separate combinations of features should also be considered to be encompassed and disclosed. Embodiments and combinations of features which do not have all of the features of an originally formulated claim should also be considered to be disclosed. In addition, embodiments and combinations of features that depart or deviate from the combinations of features set forth in the back references of the claims should be considered to be disclosed in particular by the embodiments set forth above.

Although the invention is illustrated and described herein as embodied in a food-receiving container with a dividing wall held at different height levels in different spatial directions and a method for installing a dividing wall, it is nevertheless not intended to be limited to the details shown, since various modifications and structural changes may be made therein without departing from the spirit of the invention and within the scope and range of equivalents of the claims.

DETAILED DESCRIPTION OF THE INVENTION

Figure 1:
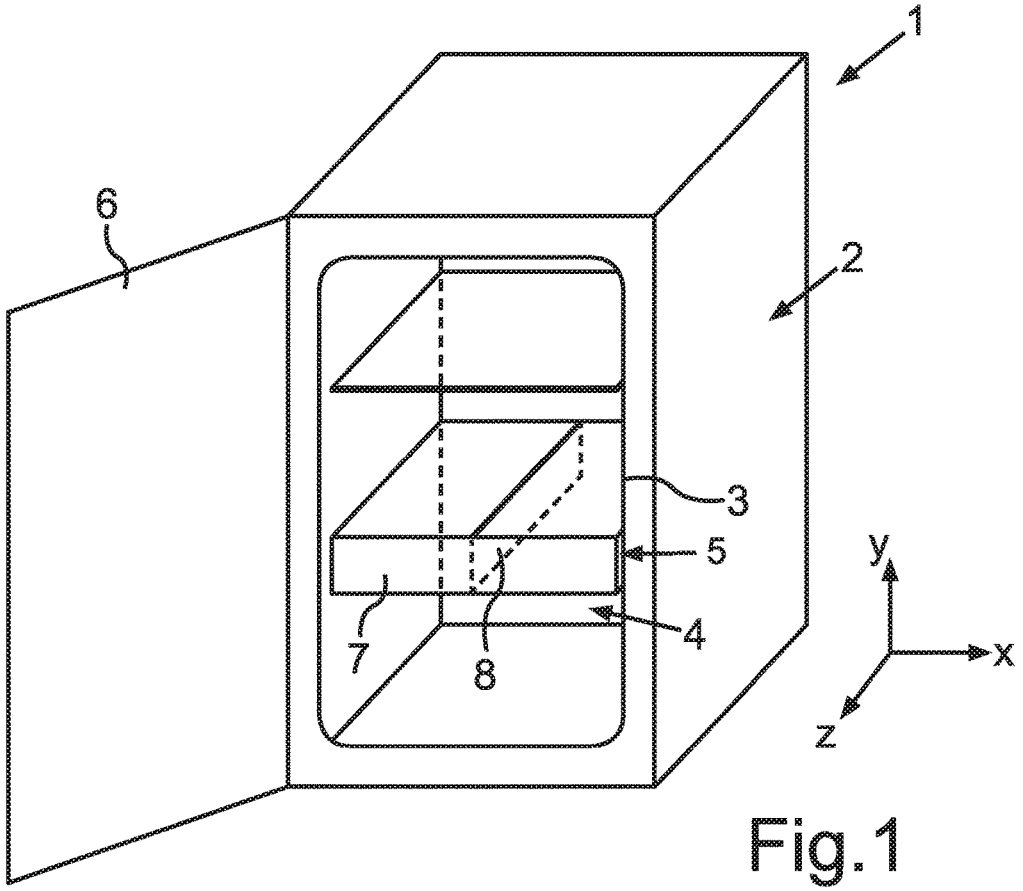
FIG. 1 is a diagrammatic, perspective view of an exemplary embodiment of a household refrigeration appliance according to the invention with an exemplary embodiment of a food-receiving container according to the invention.

Referring now in detail to the figures of the drawings, in which identical or functionally identical elements are given identical reference characters, and first, particularly, to FIG. 1 thereof, there is seen a diagrammatic view of a household refrigeration appliance 1. The household refrigeration appliance 1 can be a refrigerator or a freezer or a combined refrigerator-freezer. The household refrigeration appliance 1 is embodied to store and preserve foodstuffs. The household refrigeration appliance 1 includes a housing 2. An interior container 3 is disposed in the housing 2. The walls of the interior container 3 bound a receiving area 4 for foodstuffs. The receiving area 4 can be a chiller compartment or a freezer compartment. At least one food-receiving container 5 is disposed in the receiving area 4. Both the position and the embodiment of the food-receiving container 5 should be understood as being exemplary only. The food-receiving container 5 can be removed from the receiving area 4 and re-placed again in a non-destructively releasable manner. The household refrigeration appliance 1 furthermore includes a door 6 disposed in a hinged manner on the housing 2. The receiving area 4 can be sealed by the door 6 on the front side.

Figure 2:
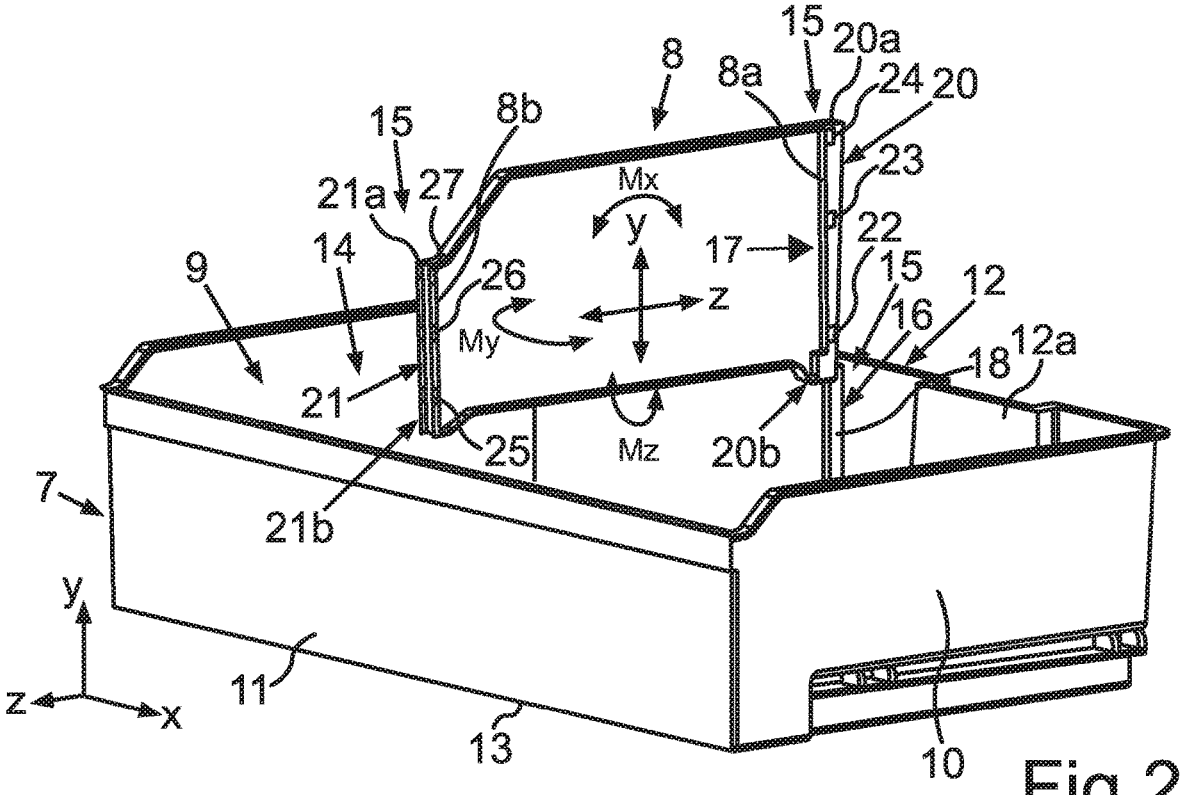
FIG. 2 is an enlarged, perspective view of a receiving bin and a dividing wall in an installed state in which the dividing wall has already achieved an initial position and is already in contact with the receiving bin or has achieved an initial position.

The food-receiving container 5 includes a receiving bin 7 and a dividing wall 8 separate therefrom. The dividing wall 8 is in particular embodied in one piece. It is in particular embodied as made of plastic. The receiving bin 7 is preferably embodied in one piece, in particular as made of plastic. The dividing wall 8 and the receiving bin 7 can be embodied in different materials. FIG. 2 shows the food-receiving container 5 in a perspective view. The separate dividing wall 8 is depicted in the removed state. The receiving bin 7 includes side walls 9 and 10, a front wall 11 and a rear wall 12. In addition, the receiving bin 7 includes a base wall 13. Foodstuffs can be placed in an interior 14 of the receiving bin 7 that is bounded by the walls 9 to 13. The separate dividing wall 8 is preferably embodied in one piece. It is in particular embodied as made of plastic. The dividing wall 8 is in particular constructed to enable the volume of the interior 14 to be divided. The dividing wall 8 can be inserted into the receiving bin 7 in a non-destructively releasable manner. The food-receiving container 5 includes a positioning device 15. This positioning device 15 is used to specifically position the dividing wall 8 when installed in the receiving bin 7 and in the final installed position. In addition, the positioning device 15 is provided not only for the positioning itself, but also to guide and hold the dividing wall 8 when it is pushed into the receiving bin 7. The positioning device 15 includes a first positioning unit 16. This first positioning unit 16 is embodied in one piece with the receiving bin 7. In addition, the positioning device 15 includes a positioning unit 17, which is separate and different from the positioning unit 16. This positioning unit 17, which can be a second positioning unit 17, is embodied in one piece with the dividing wall 8. The two positioning units 16 and 17 can be directly coupled. In particular, they engage directly with one another for the specific positioning of the dividing wall 8 in the receiving bin 7.

The positioning device 15 is embodied such that, depending on the insertion level of the dividing wall 8 into the receiving bin 7 viewed in the height direction (y-direction), different respective associated defined coupled holding states of the dividing wall 8 on the receiving bin 7 are automatically established at different defined, in particular discrete, insertion height positions. This is in particular established by the mechanically coupling positioning units 16 and 17. The different discrete insertion height positions differ in the number of coupled holding states embodied and hence the number of spatial directions in which a holding at the respective insertion height position acts. In particular, it is provided that the positioning device 15 is embodied such that the number of different coupled holding states increases as the insertion position of the dividing wall 8 into the receiving bin 7 increases. In particular, it is provided that the number of different coupled holding states at a higher-level insertion height position is lower than it is at a lower-level insertion height position. In particular, the number of different coupled holding states increases as the vertical insertion length of the dividing wall 8 into the receiving bin 7 increases. In particular, it is provided that in an uppermost first insertion height position of the dividing wall 8 into the receiving bin 7 at which the dividing wall 8 includes the initial position, a first coupled holding state is embodied, in which the dividing wall 8 is held in only one single spatial direction. This installed state is shown in FIG. 2. The initial position is in particular the position at which, with the provided insertion and provided installation scenario, the dividing wall 8 is already in contact with the receiving bin 7. In particular, this position is provided when the positioning units 16 and 17 already touch one another at one point.

In the exemplary embodiment of the food-receiving container 5 in FIG. 2, it is provided that the first positioning unit 16 includes a first bar 18. This first bar 18 extends in the height direction. It extends on an inner side 12*a* of the rear wall 12. In particular, this bar 18 extends in a straight line. The bar 18 extends over at least 80 percent of the height of this inner side 12*a*. The bar 18 is embodied without interruption over its entire length.

In addition, the first positioning unit 16 includes a second embodiment of a bar 19. This second bar 19 is separate from the first bar 18. The second bar 19 is embodied integrally on an inner side 11*a* of the front wall 11. Hence, this is also embodied in one piece with the front wall 11, as in the case with the bar 18 with the rear wall 12.

The two bars 18 and 19 are oriented parallel to one another. In particular, the second bar 19 extends vertically. The bar 19 is embodied without interruption over its entire length.

In the exemplary embodiment shown, the second positioning unit 17 includes a first groove 20. This first groove 20 is embodied on a rear edge 8*a* of the dividing wall 8. In particular, this first groove 20 extends over the entire height of this edge 8*a*. The first groove 20 is embodied without interruption and hence continuously over its entire extension.

In addition, the second positioning unit 17 includes a second groove 21. The second groove 21 is embodied on a front edge 8*b* of the dividing wall 8. The second groove 21 is embodied without interruption and hence continuously over its entire extension. The two vertical edges 8*a* and 8*b* are hence embodied opposite each other on the dividing wall 8.

A first positioning rib 22 is embodied in the first groove 20. This first positioning rib 22 is a component of the second positioning unit 17. Viewed in the height direction, a separate second positioning rib 23 is embodied in this first groove 20. This second positioning rib 23 is embodied spaced apart from the lower first positioning rib 22. In particular, it is provided that a further separate, third positioning rib 24 is embodied in this first groove 20. Viewed in the height direction, this depicts the uppermost of the preferably three positioning ribs 22, 23 and 24. The positioning ribs 22, 23, 24 are, in particular in each case, embodied with a height that is less than a fifth, in particular less than a tenth of the height of the groove 20. They are in each case disposed at only one discrete height position.

Advantageously, a plurality of separate positioning ribs are embodied in the second groove 21. In particular, in this case three positioning ribs 25, 26 and 27 are also embodied. The positioning ribs 25, 26, 27 are, in particular in each case, embodied with a height that is less than a fifth, in particular less than a tenth of the groove 20. They are in each case disposed at only one discrete height position. In particular, all the positioning ribs 22 to 26 in are each case embodied fully within the respective groove 20, 21. The positioning ribs 22 to 24 locally restrict an inside width in the depth direction (z-direction) of the groove 20. A corresponding case is embodied by the positioning ribs 25 to 27. In this case too, the inside width of the second groove 21 is restricted in a specific spatial direction, in this case the depth direction, in particular is locally restricted viewed in the height direction. In this example, the first groove 20 is embodied as open toward the rear. It is only closed in sections toward the rear at the positions of the positioning ribs 22, 23, 24. This is formed by the plate-like positioning ribs 22, 23, 24. This closure is formed up to a vertical slot in a respective positioning rib 22, 23, 24. The same applies in particular to the second groove 21, which is open toward the front, and the positioning ribs 25, 26, 27.

In one advantageous embodiment, it is provided that the two lowermost positioning ribs 22 and 25 in the height direction are disposed at the same height level when the dividing wall 8 is horizontally disposed in this regard. The second positioning ribs 23 and 26 following in the upward direction are disposed in different height levels in this regard. In this regard, the second positioning rib 23 of the rear groove 20 is embodied at a higher height level than the second positioning rib 26 in the second groove 21. In particular, in one advantageous embodiment, the uppermost and hence highest-level third positioning ribs 24 and 27 are also embodied at different height levels. In particular, the uppermost, third positioning rib 24 is disposed lying higher in the groove 20 than the third uppermost positioning rib 27 in the second groove 21.

In addition, it should also be recognized that, in the exemplary embodiment shown, an upper end 20*a* of the first groove 20 is disposed at a higher height level than an upper end 21*a* of the second groove 21. This can be seen correspondingly in a horizontal configuration of the dividing wall 8, which is not tilted about a spatial direction oriented in the width direction (x-direction) or the depth direction (z-direction).

Figure 3:
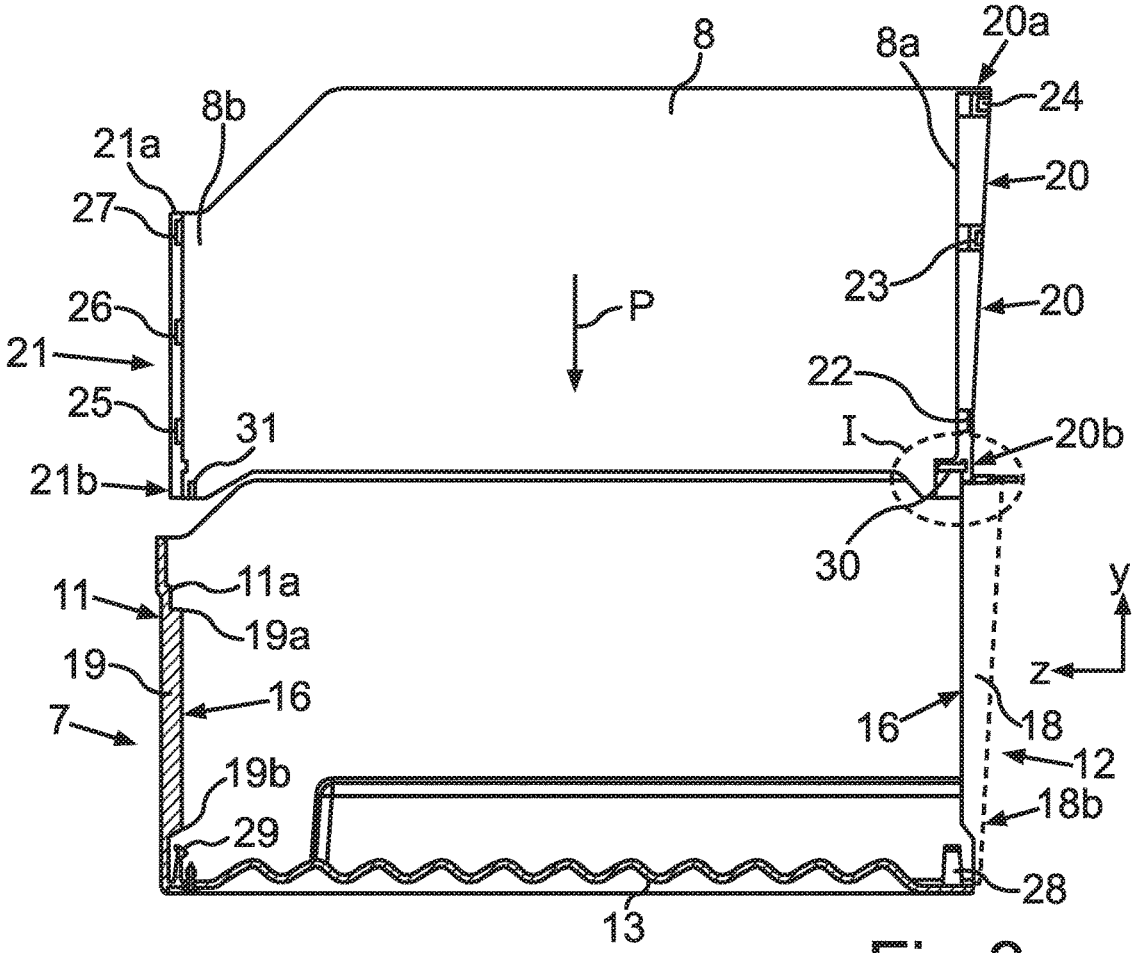
FIG. 3 is a simplified, vertical-sectional view of the embodiment of FIG. 2 in which the section is taken through the dividing wall.

As can in addition be recognized in the vertical sectional view in FIG. 3, which represents a sectional plane through the dividing wall 8 and the receiving bin 7 in the y-z plane, viewed in the height direction, an upper end 18*a* of the bar 18 is higher-lying than an upper end 19*a* of the bar 19.

In particular, the bar 18 is embodied as T-shaped in a horizontal plane and hence in a horizontal section (x-z plane) T. In particular, the bar 19 is embodied as T-shaped in a corresponding horizontal sectional plane.

As can be recognized in the sectional view according to FIG. 3, a first latching element 28 is embodied on the inner side of the base wall 13. This first latching element 28 is embodied in one piece with the base wall 13. It extends upward in the height direction. As can be recognized, this first latching element 28 is embodied in a rear end of the base wall 13. In one advantageous embodiment, this first latching element 28 is embodied as elastically resilient. In particular, it is embodied as elastically resilient about an axis, which is a spatial direction. In particular, this first latching element 28 is embodied as resilient about an axis oriented in the depth direction (z-direction).

In one advantageous embodiment, it is provided that a second latching element 29 is embodied on the base wall 13. In particular, it is it embodied thereon in one piece. The second latching element 29 is advantageously embodied with maximum spacing from the first latching element 28. The second latching element 29 is preferably embodied in a front end region of the base wall 13. In one advantageous embodiment, it is provided that this second latching element 29 is embodied as elastically resilient about an axis. In particular, in the exemplary embodiment, this axis is perpendicular to the plane of the figure. In particular, this axis is oriented in one spatial direction, in this case in particular in the width direction (x-direction). In one advantageous embodiment, these two separate latching elements 28 and 29 are hence embodied as elastically resilient in different directions, which are preferably perpendicular to one another and oriented horizontally. This can create a particularly advantageous latching of the dividing wall 8.

It is provided that a first counter-latching element 30 is embodied in the dividing wall 8. In particular, this counter-latching element 30 is embodied on a side wall, which bounds the first groove 20. In particular, this counter-latching element 30 is a recess embodied on a lower second end 20*b* of the groove 20. In one advantageous embodiment, it is provided that a second counter-latching element 31 is embodied in a wall bounding the second groove 21. The second counter-latching element 31 is preferably a recess in which the second latching element 29 is able to latch. In particular, the second counter-latching element 31 is embodied on a lower end 21*b* of the groove 21.

It is preferably provided that the inside width of the first counter-latching element 30 measured in the depth direction is greater to the extent that the first counter-latching element 28 is able to latch therein with play. This can create a tolerance compensation on positioning.

As explained above, FIG. 3 shows the installed state in which, according to the vertical installation direction P, the dividing wall 8 has already come into direct mechanical contact with the receiving bin 7. In the exemplary embodiment shown, it is the case that the rear end of the dividing wall 8 is in direct contact with the first groove 20 of the first bar 18. As can be recognized in this regard in FIG. 3, this upper end 18*a* of the first bar 18 lies further upward than the upper end 19*a* of the second bar 19. Therefore, in this initial position of the installation scenario, there is only an initial contact between the groove 20 and the bar 18. In this context, as can be recognized in FIG. 3, the second groove 21 and the second bar 19, are disposed contact-free with respect to one another. In this case, the lower end 21*b* of the second groove 21 is higher-lying than the upper end 19*a* of the bar 19. Therefore, the first bar 18 is introduced into the first groove 20. The lowermost first positioning rib 22 has not been reached yet. This positioning rib 22 is embodied as higher-lying in the first groove 20 than the lower end 20*b*. In particular, the first positioning rib 22 is also embodied as higher-lying than the counter-latching element 30. In this insertion height position, the dividing wall 8 is held at the rear end 8*a* in the width direction, in particular in this case held with play by way of example.

Figure 4:
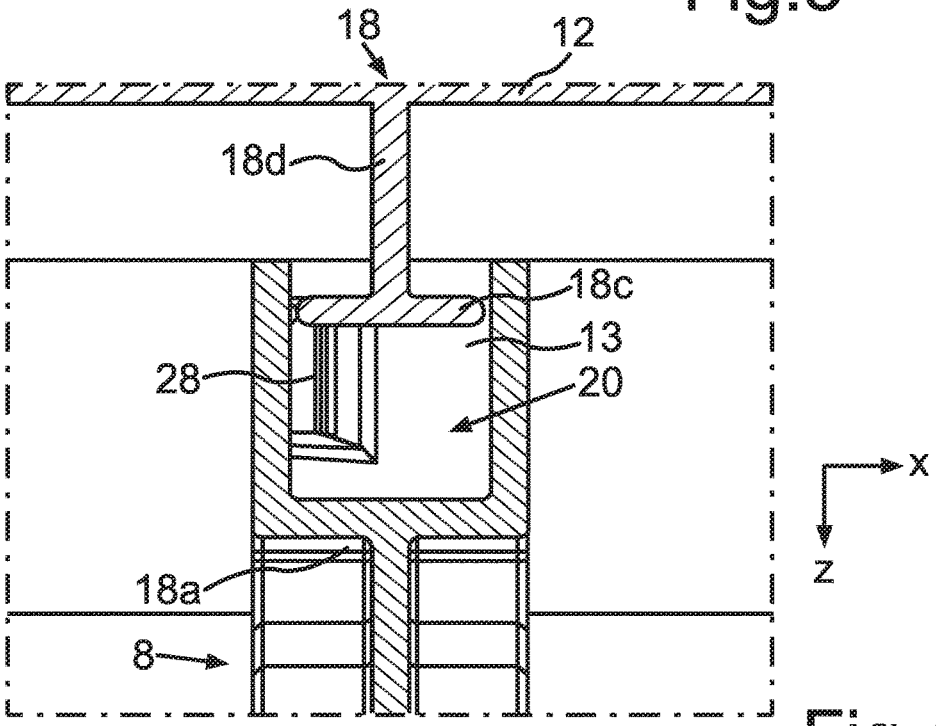
FIG. 4 is a horizontal-sectional view of the embodiment according to FIG. 2 and FIG. 3 in a rear region of the food-receiving container.

FIG. 4 shows a horizontal sectional view of the section I in FIG. 3. In this context, the sectional plane is the x-z plane. It can be recognized that the bar 18 has a T-shape. This bar 18 extends to a lower end 18*b*, as shown in FIG. 3. By way of example, this lower end 18*b* is spaced apart from the base wall 13. In the exemplary embodiment, this is correspondingly embodied for a lower end 19*b* of the second bar 19.

In the horizontal sectional view shown in FIG. 4, the T-shape is shown with a top of the T 18*c* and a foot of the T 18*d*. The top of the T 18*c* is disposed fully inside the groove 20. In this case, the sectional view is shown viewed in the negative y direction so that the first latching element 28 embodied integrally on the base wall 13 can be recognized. In this initial position, due to the embodiment of the positioning device 15, in particular of the positioning units 16 and 17, a first coupled holding state of the dividing wall 8 on the receiving bin 7 is achieved. In this regard, in this initial position, position fixing is only embodied in one single spatial direction. In this case, this is the width direction. Due to the width of the foot of the T 18*c*, this embodiment can fit precisely or have a maximum play of 1 mm. The bar 18 and the groove 20 are coupled by mutual engagement.

Figure 5:
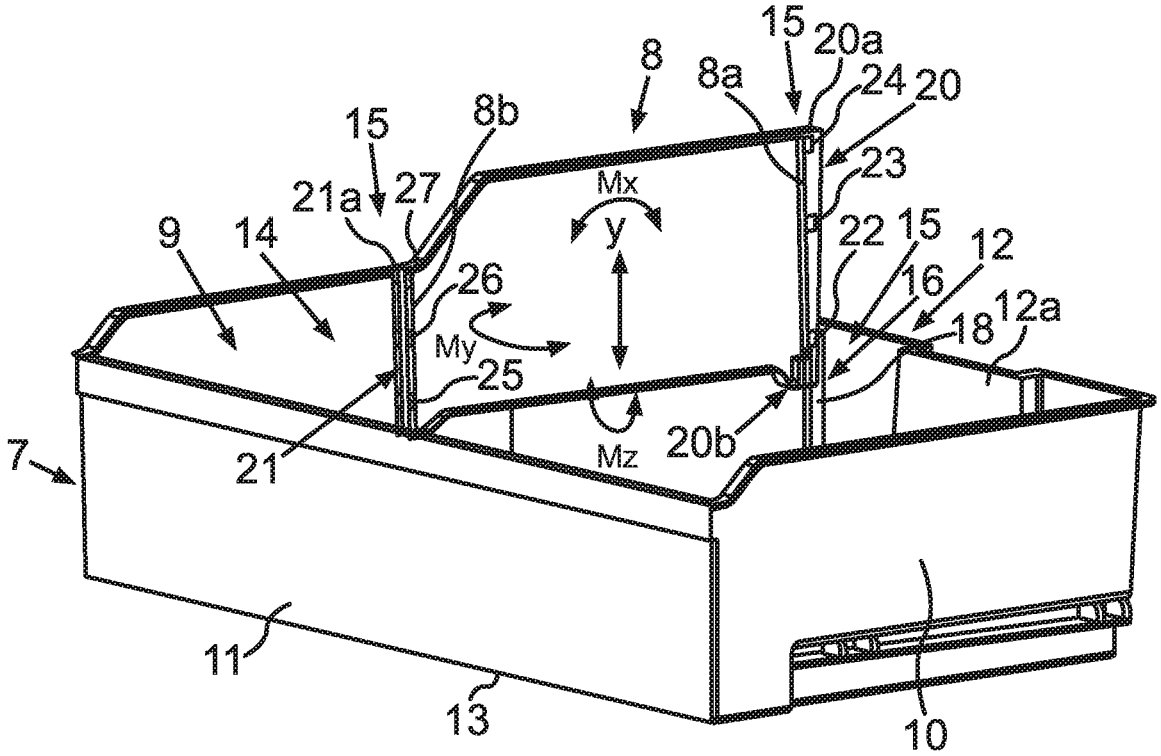
FIG. 5 is a perspective view of the receiving bin and the dividing wall in an installed state in which the dividing wall is inserted further than in the case of FIG. 2 and has achieved an insertion height position in which a groove is coupled with a bar and a lowermost positioning rib in the groove overlaps the bar in the height direction.

If now, starting from the installed state such as that achieved in FIGS. 2 to 4, the dividing wall 8 is pushed further down in the vertical direction and hence pushed further into the receiving bin 7, the installed state according to FIG. 5 is achieved. In this installed state, in which the dividing wall 8, has achieved a further lower-lying insertion height position compared to the initial position, a further positioning takes place in a second spatial direction. For this purpose, FIG. 5 shows an installed state of the dividing wall 8 that is lower-lying than that in FIG. 2. As can be recognized in the horizontal sectional view in FIG. 7, in this insertion height position according to FIG. 5, the bar 18 has arrived in a narrow point of the groove 20. This narrow point is formed by the lowermost first positioning rib 22. The narrow point in this regard means that that an inside width W1 of the groove 20 measured in the depth direction is reduced or decreased. The groove 20 is closed toward the rear by the first plate-like positioning rib 22. As a result, now a state is achieved in which the dividing wall 8 in a second spatial direction oriented perpendicular to the first spatial direction includes a coupled holding state. The second spatial direction is a horizontal spatial direction. In the present exemplary embodiment, this is the depth direction. This second spatial direction is oriented in the direction in which the surface of the dividing wall 8 extends. The first positioning rib 22 only includes a vertical continuous slot through which the stem of the T 18*d* extends.

Figure 6:
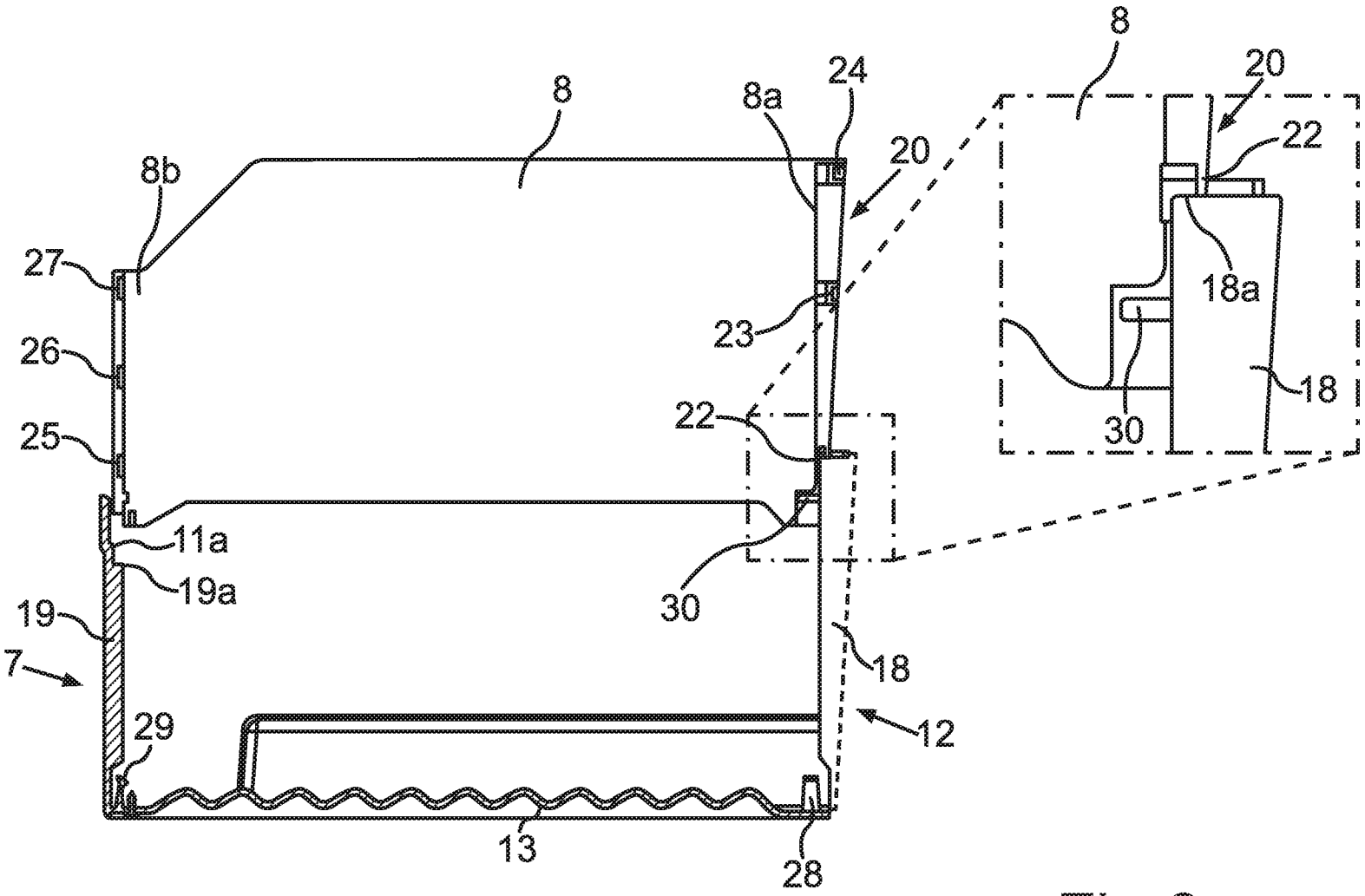
FIG. 6 is a vertical-sectional view of the embodiment in FIG. 5 in which the section is taken through the dividing wall.
Figure 7:
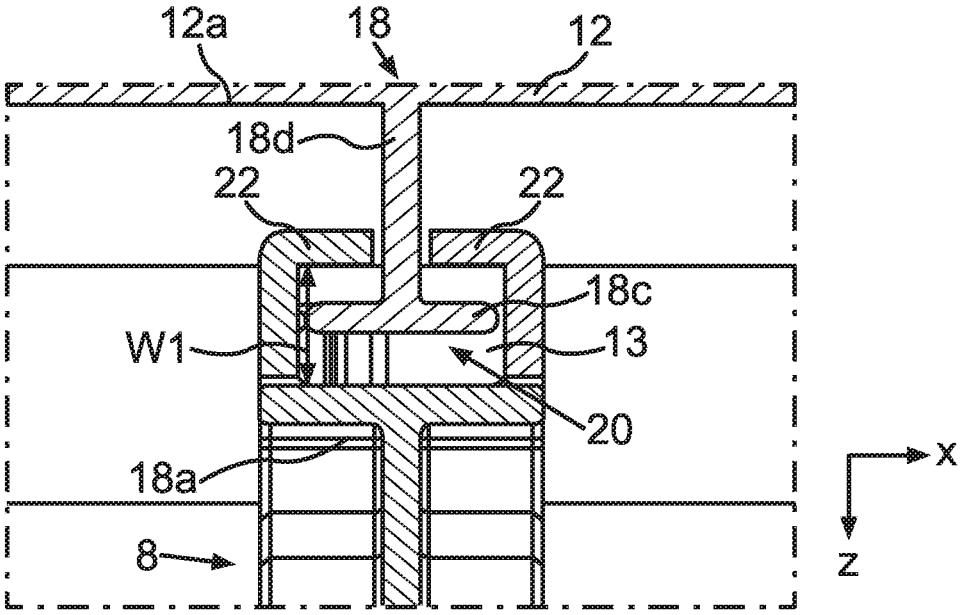
FIG. 7 is a horizontal-sectional view of the embodiments according to FIGS. 5 and 6 in a rear region of the food-receiving container.

In particular, the further coupled holding state in this second spatial direction also means that the dividing wall 8 is disposed captively on the receiving bin 7 in this insertion height position according to FIGS. 5, 6 and 7. This means that, in this defined discrete insertion height position according to FIG. 5 to FIG. 7, the dividing wall 8 can no longer be removed from the receiving bin 7 by a straight-line movement in the depth direction. In particular, in this insertion height position according to FIGS. 5 to 6, the front end 8*b* of the dividing wall 8 is not yet in contact with the second groove 21 with the second bar 19. In particular, in this defined discrete insertion height position according to FIG. 5 to FIG. 7, the front end of the dividing wall 8 at the front end is still embodied with no contact with the second bar 19, in particular completely without contact with the front wall 11. As can be recognized in the view in FIG. 7, in this insertion height position, the dividing wall 8 is disposed spaced apart from the inner side 12*a*.

FIG. 6 shows a vertical sectional view of the configuration according to FIG. 5, wherein in this case the sectional plane extends through the dividing wall 8 with the receiving bin 7. It can be provided that, in particular, in this embodiment, the front end 8*b* of the dividing wall 8 with the walls bounding the second groove 21, already lies on an inner side 11*a* of the front wall 11.

FIG. 7 depicts the horizontal sectional view of the embodiment according to FIG. 5 in the rear region in which the bar 18 and the groove 20 are shown.

In this installed state according to FIGS. 5 to 7, the length and the deformation of the dividing wall 8 still enables a slight rotation about the y-axis and a slight tilting about the z-axis.

Figure 8:
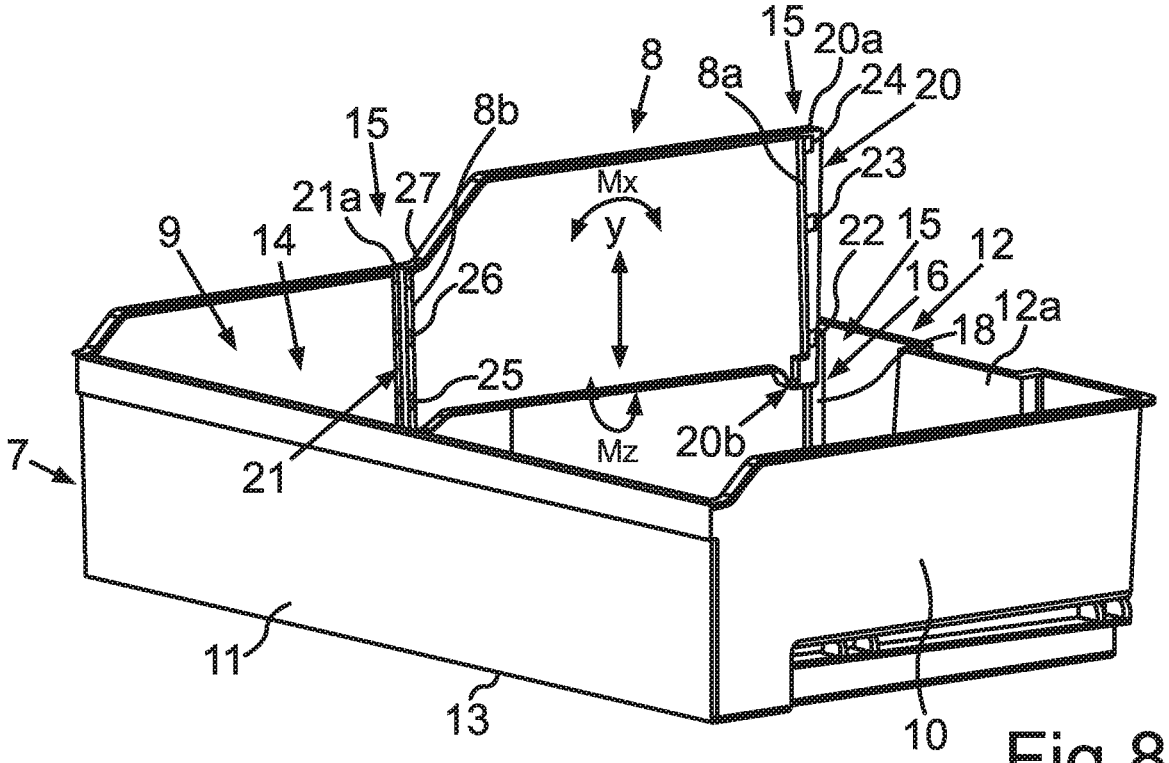
FIG. 8 is a perspective view of the receiving bin and the dividing wall in an installed state, which follows the installed state in FIG. 5 and in which both grooves and both bars are coupled by mutual engagement.
Figure 9:
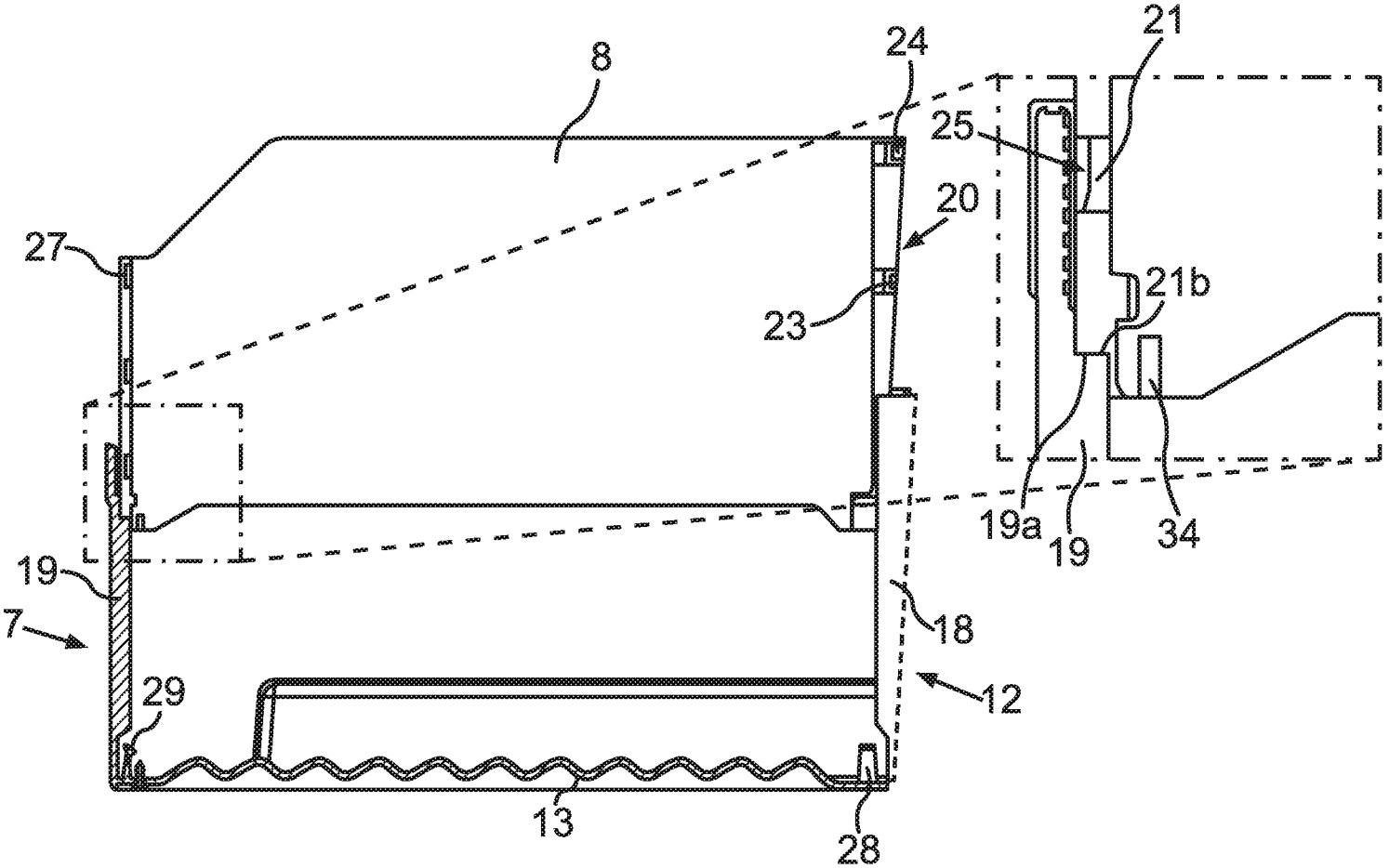
FIG. 9 is a vertical-sectional view of the partial region of the food-receiving container according to FIG. 8.

If now, starting from the installed state, as was achieved according to FIG. 5 to FIG. 7, the dividing wall 8 is subsequently inserted vertically downward into the receiving bin 7, an insertion height position of the dividing wall 8 is then achieved at which the end 21*b* of the second groove 21 reaches the upper end 19*a* of the second bar 19 and the second bar 19 engages in the second groove 21. Hence, the second groove 21 and the bar 19 are engaged and coupled with one another. The second bar 19 is then immersed in this second groove 21. This is shown in FIG. 8. In FIG. 9, this is shown as a vertical sectional view through the dividing wall 8. This also shows a correspondingly simplified view as in FIG. 6 and FIG. 3 with regard to the sectional view of the sectional surfaces. In this installed state, in which this further lower-lying insertion height position is achieved, a further coupled holding state is then achieved. A displacement of the dividing wall 8 in the depth direction is then in particular no longer possible. Hence, in this insertion height position coupled holding states are achieved in a first horizontal spatial direction, in particular the width direction, and in a second horizontal spatial direction perpendicular thereto, in particular in the depth direction. It is in this intermediate position, which is achieved spaced apart from the initial position and from the fully pushed-in final position, that then only movement in one spatial direction, namely the height direction, is enabled.

In the installed state shown in FIGS. 8 and 9, form-locking is achieved between the dividing wall 8 and the receiving bin 7, in particular also at the front. Hence, even a slight rotation about the y-axis is excluded from this insertion height position. In particular, tolerances at the front coupling region between the dividing wall 8 and the receiving bin 7 are kept very tight in order to achieve a fixed mounting there. In particular, this also achieves bracing of the front wall 11. With the narrow tolerances, in particular in the low tenths of a millimeter range, the dividing wall 8 also acts as a rib for the front wall 11.

If, starting from this insertion height position shown in in FIG. 8 and FIG. 9, the dividing wall 8 is inserted further downward into the receiving bin 7 by a linear vertical movement, the installed state is achieved in which the dividing wall 8 has achieved a further lower-lying insertion height position. In this position, the second bar 19 is then brought in the vertical direction to overlap with the lower positioning rib 25 in the second groove 21. This causes the position of the dividing wall 8 to be additionally held. This lower positioning rib 25, which restricts the inside width of the second groove 21 measured in the depth direction further improves the coupled holding state of the dividing wall 8 in this regard. In particular, as a result, tilting about this second horizontal spatial direction, namely the depth direction, as well as the first horizontal spatial direction, the width direction, is prevented. In particular, hence at least the region of the dividing wall 8 is also fixed in position in these two horizontal spatial directions.

Upon the further insertion of the dividing wall 8 into the receiving bin 7, the front bar 19 then passes the second higher-lying positioning rib 26. When it is pushed further downward, the upper end 18*a* of the bar 18 then passes the second higher-lying positioning rib 23. Again, when the dividing wall 8 is pushed further into the receiving bin 7, the upper end 19*a* of the second bar 19 passes the upper positioning rib 27. In particular, in this installation moment, the upper end 18*a* of the first bar 18 simultaneously passes the upper higher-level positioning rib 24 in the groove 20.

Figure 10:
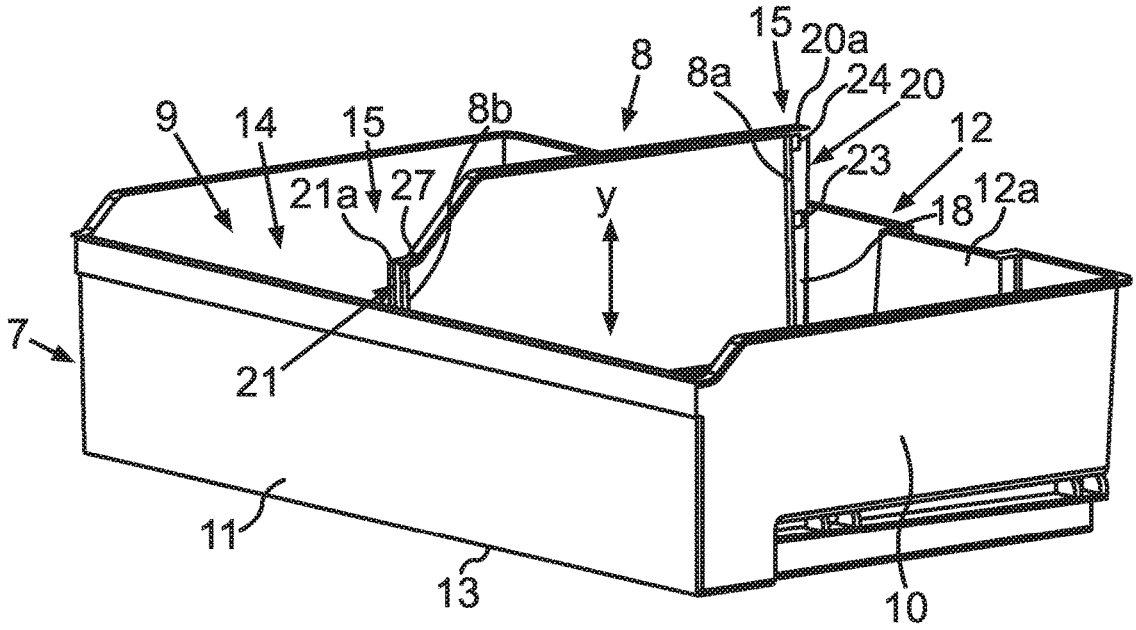
FIG. 10 is a perspective view of the components according to FIG. 8 in a further installed state different therefrom.
Figure 11:
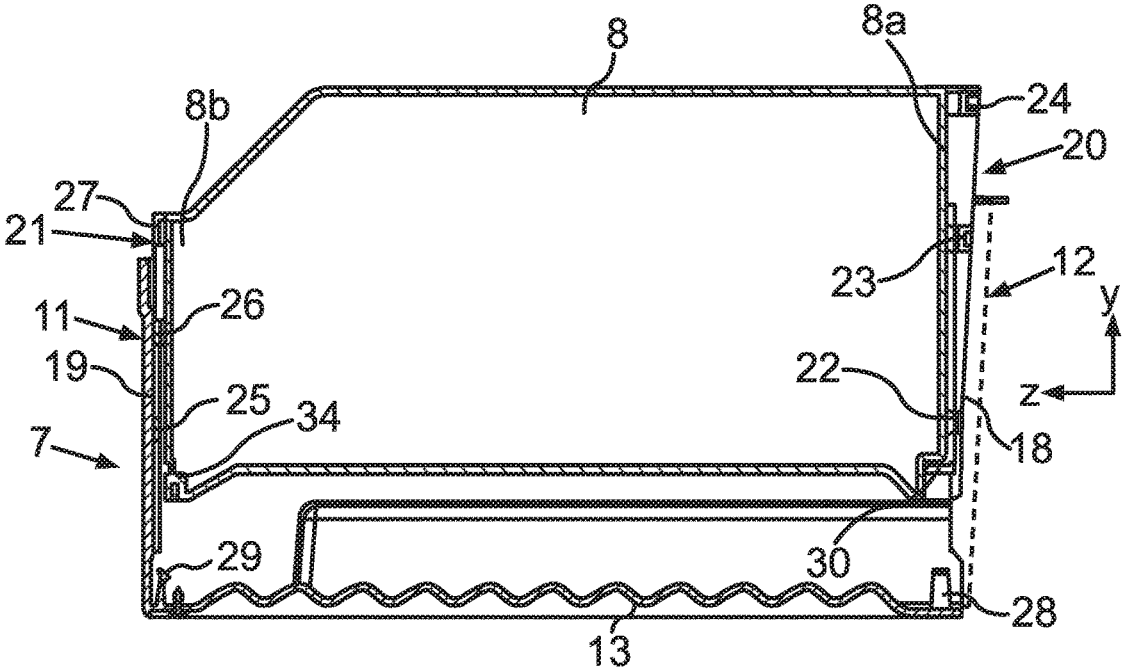
FIG. 11 is a simplified vertical-sectional view of the food-receiving container according to FIG. 9 in which the section is taken through the dividing wall.

FIG. 10 is a perspective view of the installation state in which the dividing wall 8 has already passed the two positioning ribs 23 and 26 through the upper ends 18*a* and 19*a* of the bars 18 and 19. In this case, an insertion height position of the dividing wall 8 is achieved in which the upper ends 18*a* and 19*a* have not yet reached the upper positioning ribs 24 and 27. In this context, FIG. 11 shows a vertical sectional view through the dividing wall 8 and the receiving bin 7 according to the position in FIG. 10. In this installed state, tilting about the z-axis is also fully prevented. Now, displacement is only possible in the y-axis.

Figure 12:
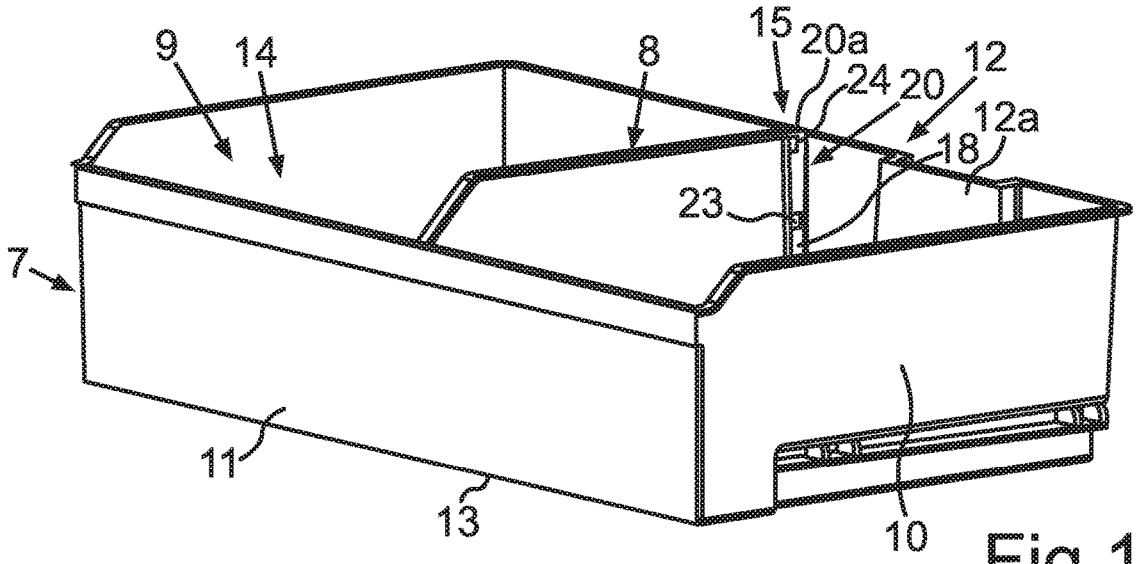
FIG. 12 is a perspective view of the food-receiving container in a further installed state following FIG. 9 in which the dividing wall is inserted in the final position.
Figures 13, 14A, 14B, 14C:
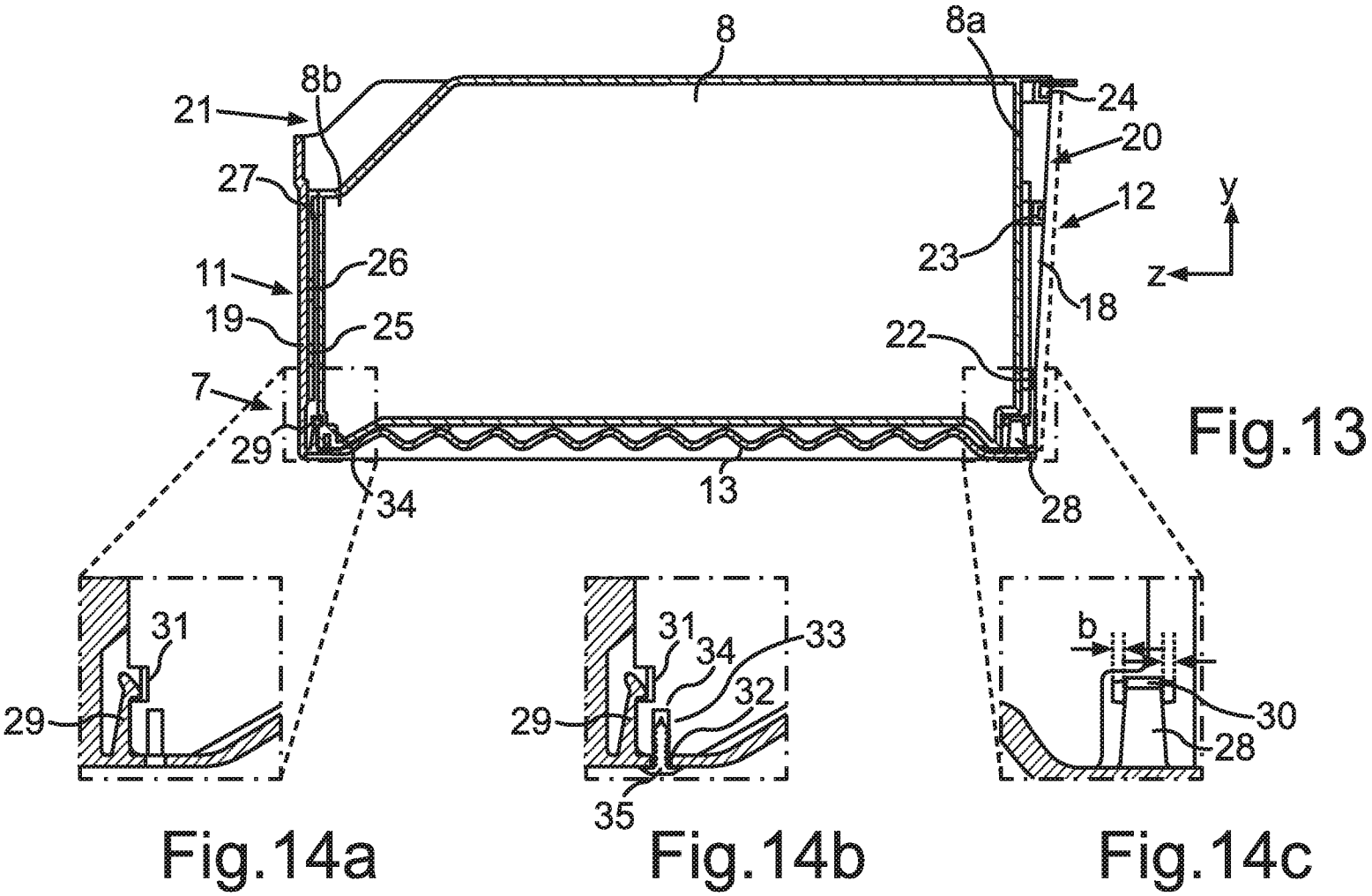
FIG. 13 is a simplified vertical-sectional view through the food-receiving container according to FIG. 12.
FIGS. 14*a* to 14*c* are fragmentary, vertical-sectional views of FIG. 13.

If, starting from this intermediate installation in FIG. 10 and FIG. 11, the dividing wall 8 is pushed further into the receiving bin 7, the final state of the dividing wall 8 shown in FIG. 12 is achieved. As explained above, in this final fully inserted position of the dividing wall 8, the upper ends 18*a* and 19*a*, have reached the upper positioning ribs 24 and 27 or are disposed overlapping therewith in the height direction. In addition, in this final fully pushed-in state of the dividing wall 8 into the receiving bin 7, latching of the latching elements 28 and 29 with the counter-latching elements 30 and 31 is automatically achieved. In this final position, a locked position fixing of the dividing wall 8 in the third spatial direction, in this case the height direction, is then achieved. In this context, FIG. 13 again shows a vertical sectional view of the configuration according to FIG. 12 in the region of the dividing wall 8 and the receiving bin 7. In FIGS. 12 and 13, the still further coupled holding state is also achieved.

The first latching element 28 is latched in the counter-latching element 30 about the axis oriented in the depth direction. The second latching element 29 is latched in the counter-latching element 31 from behind about an axis that is perpendicular to the plane in the figure and hence oriented in the width direction.

In particular a floating bearing is embodied in the rear coupling region between the dividing wall 8 and the receiving bin 7. As a result, displacement of the dividing wall 8, for example due to a change in temperature or deformation is enabled. This can also counteract distortion and the resulting damage.

FIG. 14*a* shows the latched state of the second latching element 29 in this second counter-latching element 31 in this regard.

FIG. 14*b* shows a further advantageous state, in which additionally to this positioning device 15, a second fastening facility 33 separate therefrom is embodied. In this regard, a screw boss 34 is embodied in one piece in the dividing wall 8. This screw boss 34 is open toward the bottom. Thus, it is possible for a screw 35 to be screwed from below through a hole 32 in the base wall 13 into this screw boss 34.

FIG. 14*c* shows an enlarged view of the rear region shown in FIG. 13. This shows the latched state between the first latching element 28 and the counter-latching element 30. It can also be recognized that a tolerance measure b is provided therein between the inside width of the counter-latching element 30 and the first latching element 28. The first latching element 28 can hence latch in this counter-latching element 30 with play, wherein this is viewed in the depth direction.

LIST OF REFERENCE CHARACTERS

1 Household refrigeration appliance
2 Housing
3 Interior container
4 Receiving area
5 Food-receiving container
6 Door
7 Receiving bin
8 Dividing wall
8*a* Rear edge
8*b* Front edge
9 Side wall
10 Side wall
11 Front wall
11*a* Inner side
12 Rear wall
12*a* Inner side
13 Base wall
14 Interior
15 Positioning device
16 Positioning unit
17 Positioning unit
18 Bar
18*a* Upper end
18*b* Lower end
18*c* Top of the T
18*d* Foot of the T
19 Bar
19*a* Upper end
19*b* Lower end
20 Groove
20*a* Upper end
20*b* Lower end
21 Groove
21*a* Upper end
21*b* Lower end
22 Positioning rib
23 Positioning rib
24 Positioning rib
25 Positioning rib
26 Positioning rib
27 Positioning rib
28 Latching element
29 Latching element
30 Counter-latching element
31 Counter-latching element
32 Hole
33 Fastening facility
34 Screw boss
35 Screw
P Installation direction
W1 Inside width
b Tolerance measure
x Width direction
y Height direction
z Depth direction Mx Moment about the x-axis
My Moment about the y-axis
Mz Moment about the z-axis

The invention claimed is:

1. A food-receiving container for a household refrigeration appliance, the food-receiving container comprising:

a receiving bin having an interior space with a volume;

a dividing wall being separate from said receiving bin and configured to be inserted from above into said receiving bin to divide said volume of said interior space of said receiving bin;

a positioning device for specifically positioning said dividing wall upon installing said dividing wall in said receiving bin and in an installed final pushed-in position of said dividing wall;

said positioning device including a first positioning unit formed in one piece with said receiving bin and a second positioning unit being separate from said receiving bin and formed in one piece with said dividing wall, said positioning units engaging with one another for said specific positioning of said dividing wall relative to said receiving bin;

said mutually engaging positioning units automatically establishing different respective defined coupled holding states of said dividing wall with said receiving bin at defined different insertion height positions depending on an insertion level of said dividing wall into said receiving bin in a height direction of the food-receiving container;

said different insertion height positions differing in a number of said coupled holding states being provided and hence in a number of spatial directions in which said coupled holding states act, and said dividing wall having a position in said receiving bin being fixed in all three spatial directions in said final pushed-in position;

in an upper first insertion height position of said dividing wall into said receiving bin in said height direction, said positioning units being coupled by mutual engagement resulting in a first coupled holding state being established in which said dividing wall is set in only one spatial direction directed perpendicular to an areal extension of said dividing wall;

in a lower-lying further second insertion height position of said dividing wall into said receiving bin said positioning units being coupled by mutual engagement resulting, in addition to said first coupled holding state, in a second coupled holding state being established in which said dividing wall is set in a further spatial direction directed in a direction of said areal extension of said dividing wall; and in a final fully inserted position, which is a further lower-lying third insertion height position of said dividing wall into said receiving bin, said positioning units being coupled by mutual engagement resulting, in addition to said first and second coupled holding states, in a third coupled holding state being established in which said dividing wall is held in a further spatial direction corresponding to an insertion direction of said dividing wall into said receiving bin.

2. The food-receiving container according to claim 1, wherein said number of different coupled holding states is lower at a higher-level insertion height position than at a lower-level insertion height position.

3. The food-receiving container according to claim 2, wherein said number of different coupled holding states increases as a vertical insertion length of said dividing wall into said receiving bin increases.

4. A food-receiving container for a household refrigeration appliance, the food-receiving container comprising:

a receiving bin having an interior space with a volume;

a dividing wall being separate from said receiving bin and configured to be inserted from above into said receiving bin to divide said volume of said interior space of said receiving bin;

a positioning device for specifically positioning said dividing wall upon installing said dividing wall in said receiving bin and in an installed final pushed-in position of said dividing wall;

said positioning device including a first positioning unit formed in one piece with said receiving bin and a second positioning unit being separate from said receiving bin and formed in one piece with said dividing wall, said positioning units engaging with one another for said specific positioning of said dividing wall relative to said receiving bin;

said mutually engaging positioning units automatically establishing different respective defined coupled holding states of said dividing wall with said receiving bin at defined different insertion height positions depending on an insertion level of said dividing wall into said receiving bin in a height direction of the food-receiving container;

said different insertion height positions differing in a number of said coupled holding states being provided and hence in a number of spatial directions in which said coupled holding states act, and said dividing wall having a position in said receiving bin being fixed in all three spatial directions in said final pushed-in position;

one of said positioning units including at least one vertically oriented groove having positioning ribs disposed at different height levels permitting said groove, when in a coupled state with another of said positioning units, to establish a coupled holding state of said dividing wall in one spatial direction and permitting said positioning ribs to establish a coupled holding state of said dividing wall in a further spatial direction perpendicular to said one spatial direction.

5. The food-receiving container according to claim 4, wherein at least three of said positioning ribs are disposed at different height levels being spaced apart in said groove.

6. The food-receiving container according to claim 5, wherein said other positioning unit includes at least one bar with a T-shaped cross section being vertically oriented and engaging in said groove in a coupled state with said one positioning unit.

7. The food-receiving container according to claim 6, wherein said other positioning unit includes a first T-shaped bar having an upper end in said height direction being located at a first height position and a second vertically oriented T-shaped bar being separate from said first T-shaped bar and having an upper end in said height direction being located at a second height level being lower than said first height level.

8. The food-receiving container according to claim 7, wherein:

said at least one vertically oriented groove of said positioning unit includes mutually separate, vertically-extending first and second grooves;

in a first upper insertion height position only said first bar is coupled with said first groove and engages in said first groove and said second groove is decoupled from said second bar, and in a lower further insertion height position in said height direction, said second bar is coupled with said second groove and engages in said second groove.

9. The food-receiving container according to claim 4, wherein said one positioning unit is said second positioning unit and said other positioning unit is said first positioning unit.

10. The food-receiving container according to claim 9, wherein:

said receiving bin includes at least one side wall having an inner side, and said first positioning unit is disposed on said inner side of said at least one side wall; and said dividing wall has at least one vertical edge, and said second positioning unit is disposed on said least one vertical edge.

11. The food-receiving container according to claim 9, wherein:

said receiving bin includes a base wall and opposing first and second side walls having inner sides, and said first positioning unit is disposed on at least one of said side walls and said base wall or on said inner side of said first side wall and said inner side of said second side wall or on said inner sides of two of said side walls and said base wall; and said dividing wall includes first and second mutually opposite vertical edges, and said second positioning unit is disposed on said first and second vertical edges.

12. A food-receiving container for a household refrigeration appliance, the food-receiving container comprising:

a receiving bin having an interior space with a volume;

a dividing wall being separate from said receiving bin and configured to be inserted from above into said receiving bin to divide said volume of said interior space of said receiving bin;

a positioning device for specifically positioning said dividing wall upon installing said dividing wall in said receiving bin and in an installed final pushed-in position of said dividing wall;

said positioning device including a first positioning unit formed in one piece with said receiving bin and a second positioning unit being separate from said receiving bin and formed in one piece with said dividing wall, said positioning units engaging with one another for said specific positioning of said dividing wall relative to said receiving bin;

said mutually engaging positioning units automatically establishing different respective defined coupled holding states of said dividing wall with said receiving bin at defined different insertion height positions depending on an insertion level of said dividing wall into said receiving bin in a height direction of the food-receiving container;

said different insertion height positions differing in a number of said coupled holding states being provided and hence in a number of spatial directions in which said coupled holding states act, and said dividing wall having a position in said receiving bin being fixed in all three spatial directions in said final pushed-in position;

said first positioning unit including at least one latching element, and said second positioning unit including at least one counter-latching element configured to be coupled with said at least one latching element;

said at least one counter-latching element being coupled with said at least one latching element in said final pushed-in position of said dividing wall into said receiving bin, and coupling of said latching and counter-latching elements establishing a locked coupled holding state of said dividing wall in a spatial direction corresponding to an insertion direction.

13. A food-receiving container for a household refrigeration appliance, the food-receiving container comprising:

a receiving bin having an interior space with a volume;

a dividing wall being separate from said receiving bin and configured to be inserted from above into said receiving bin to divide said volume of said interior space of said receiving bin;

a positioning device for specifically positioning said dividing wall upon installing said dividing wall in said receiving bin and in an installed final pushed-in position of said dividing wall;

said positioning device including a first positioning unit formed in one piece with said receiving bin and a second positioning unit being separate from said receiving bin and formed in one piece with said dividing wall, said positioning units engaging with one another for said specific positioning of said dividing wall relative to said receiving bin;

said mutually engaging positioning units automatically establishing different respective defined coupled holding states of said dividing wall with said receiving bin at defined different insertion height positions depending on an insertion level of said dividing wall into said receiving bin in a height direction of the food-receiving container;

said different insertion height positions differing in a number of said coupled holding states being provided and hence in a number of spatial directions in which said coupled holding states act, and said dividing wall having a position in said receiving bin being fixed in all three spatial directions in said final pushed-in position;

said first positioning unit including at least one latching element, and said second positioning unit including at least one counter-latching element configured to be coupled with said at least one latching element;

said at least one latching element including a first resilient latching element being resilient about a first axis and oriented in a horizontal first spatial direction, and a second resilient latching element being separate from said at least one latching element, being resilient about a second axis and being oriented in a second horizontal spatial direction oriented perpendicularly to said first spatial direction.

14. The food-receiving container according to claim 13, wherein said receiving bin has a base wall, and said latching elements are formed in one piece on said base wall and protrude upwardly in said height direction.

15. The food-receiving container according to claim 1, wherein said dividing wall includes at least one screw boss, and a screw is configured to be screwed into said screw boss for screwing said dividing wall to said receiving bin in addition to said positioning by said positioning device.

16. A method for installing a dividing wall of a food-receiving container in a receiving bin of the food-receiving container, the method comprising the following steps:

inserting the dividing wall from above into the receiving bin in a height direction of the food-receiving container and fixing the dividing wall in the receiving bin;

using a positioning device of the food-receiving container to specifically guide and position the dividing wall during installation and in a final pushed-in position in the receiving bin;

engaging a first positioning unit of the positioning device formed in one piece with the receiving bin with a second positioning unit of the positioning device being separate from the receiving bin and formed in one piece with the dividing wall, for the specific positioning of the dividing wall relative to the receiving bin;

using the mutually engaging positioning units to automatically establish different respective defined coupled holding states of the dividing wall with the receiving bin at different defined insertion height positions, depending upon an insertion level of the dividing wall into the receiving bin in the height direction, the different insertion height positions differing in a number of coupled holding states being provided and hence in a number of spatial directions in which the coupled holding states act;

fixing the position of the dividing wall in the receiving bin in all three spatial directions in the final pushed-in position;

in an upper first insertion height position of the dividing wall into the receiving bin in the height direction, coupling the positioning units by mutual engagement resulting in a first coupled holding state being established in which the dividing wall is set in only one spatial direction directed perpendicular to an areal extension of the dividing wall;

in a lower-lying further second insertion height position of the dividing wall into the receiving bin, coupling the positioning units by mutual engagement resulting, in addition to the first coupled holding state, in a second coupled holding state being established in which the dividing wall is set in a further spatial direction directed in a direction of the areal extension of the dividing wall; and in a final fully inserted position, which is a further lower-lying third insertion height position of the dividing wall into the receiving bin, coupling the positioning units by mutual engagement resulting, in addition to the first and second coupled holding states, in a third coupled holding state being established in which the dividing wall is held in a further spatial direction corresponding to an insertion direction of the dividing wall into the receiving bin.

* * * * *